US007070129B1

(12) United States Patent
Raghu et al.

(10) Patent No.: US 7,070,129 B1
(45) Date of Patent: Jul. 4, 2006

(54) SPA TUB FLUIDIC NOZZLES

(75) Inventors: Surya Raghu, Ellicott City, MD (US); Dharapuram N. Srinath, Ellicott City, MD (US); Sean T. Burns, Columbia, SC (US)

(73) Assignee: Bowles Fluidics Corporation, Columbia, MD (US)

( * ) Notice: Subject to any disclaimer, the term of this patent is extended or adjusted under 35 U.S.C. 154(b) by 1025 days.

(21) Appl. No.: 09/602,018

(22) Filed: Jun. 23, 2000

Related U.S. Application Data

(63) Continuation-in-part of application No. 09/427,985, filed on Oct. 27, 1999, now Pat. No. 6,978,951.

(60) Provisional application No. 60/140,676, filed on Jun. 24, 1999.

(51) Int. Cl.
*B05B 1/08* (2006.01)

(52) U.S. Cl. ..... 239/589.1; 239/428; 239/429; 239/434

(58) Field of Classification Search ..... 239/426, 239/428.5, 429, 433, 434, 589.1
See application file for complete search history.

(56) References Cited

U.S. PATENT DOCUMENTS 3,337,135 A * 8/1967 Blakely et al. ..... 239/589.1
3,776,460 A * 12/1973 Fitcher ..... 239/101
4,184,636 A * 1/1980 Bauer ..... 239/589.1
4,227,550 A * 10/1980 Bauer et al. ..... 239/589.1
4,662,568 A * 5/1987 Bauer ..... 239/589.1
RE33,605 E 6/1991 Bauer ..... 239/589.1
5,129,585 A 7/1992 Bauer ..... 239/589.1
5,862,543 A 1/1999 Reynoso et al. ..... 4/541.6

* cited by examiner

*Primary Examiner*—Christopher Kim
(74) *Attorney, Agent, or Firm*—Jim Zegeer

(57) ABSTRACT

A therapeutic spa tub having a waterline and one or more fluidic nozzles for issuing therapeutic jets of water into the tub. The one or more water nozzles each comprises a housing having an inlet for receiving a flow of water under pressure, a fluidic oscillator having an oscillation chamber and at least one power nozzle coupled to the inlet and the oscillation chamber for projecting at least one jet of water into the oscillation chamber in one or more outlets from said oscillation chamber for issuing one or more pulsating jets of water into the spa tub below the waterline. An air passage in the outlet entrains ambient air in water passing through the outlet. The fluidic oscillator is a low frequency reversing chamber oscillator wherein the oscillation chamber has a reversing wall. The power nozzle is centrally located for issuing a jet of water toward the reversing wall, and a pair of liquid passages leads from the reversing chamber on each side of the power nozzle, respectively, for alternating carrying periodic pulses of water and wherein the outlet passages are smoothly extended to intersect at a common outlet to ambient and water from the passages merge to form a low-frequency swept jet of water, and the passages are dimensioned and angulated relative to each other to control a fan angle of liquid jet which is periodically swept into said common outlet to ambient water in said tub.

3 Claims, 8 Drawing Sheets

SPA TUB FLUIDIC NOZZLES

REFERENCE TO RELATED APPLICATIONS

This application is the subject of provisional application Ser. No. 60/140,676 entitled FLUIDIC SPA NOZZLES filed Jun. 24, 1999. The application is a continuation-in-part of application Ser. No. 09/427,985 filed Oct. 27, 1999 now U.S. Pat. No. 6,978,951 for REVERSING CHAMBER OSCILLATOR (incorporated herein by reference).

BACKGROUND AND BRIEF DESCRIPTION OF THE INVENTION

The present invention relates to spa tub nozzles incorporating fluidic nozzles under submerged water conditions for obtaining massaging effects by the action of an oscillating jet of water.

The current method of production of such effects is by use of a pair of jets issuing from a rotating head. The problem with this arrangement is the complexity of the system and the wear and tear of the moving parts.

According to the present invention, a fluidic nozzle, preferably of a reversing chamber type, provides a simple, no-moving part alternative to the complex method of producing the feel and sense of varying pressure application points on the human body surface in a spa tub.

While different types of fluidic nozzles can be used in the invention to produce variations in the massage effect including feedback (Bray U.S. Pat. No. 4,463,904 entitled COLD WEATHER FLUIDIC FAN SPAY DEVICE AND METHOD) or multiple power nozzle-type (Raghu PCT/US99/21463) fluidic oscillators or feedback-free oscillators. According to the present invention, a reversing chamber fluidic oscillator is used in the preferred embodiment. In this preferred embodiment, the oscillator has a much lower frequency and better packageability for spas in that the length of the reversing chamber can be manipulated easier than the length of feedback channels or the feed configuration in the multiple power nozzle-type oscillator.

DESCRIPTION OF THE DRAWINGS

The above and other objects, advantages, and features of the present invention will become apparent when considered with the following specification and accompanying drawings wherein.

DETAILED DESCRIPTION OF THE INVENTION

Figure 1:
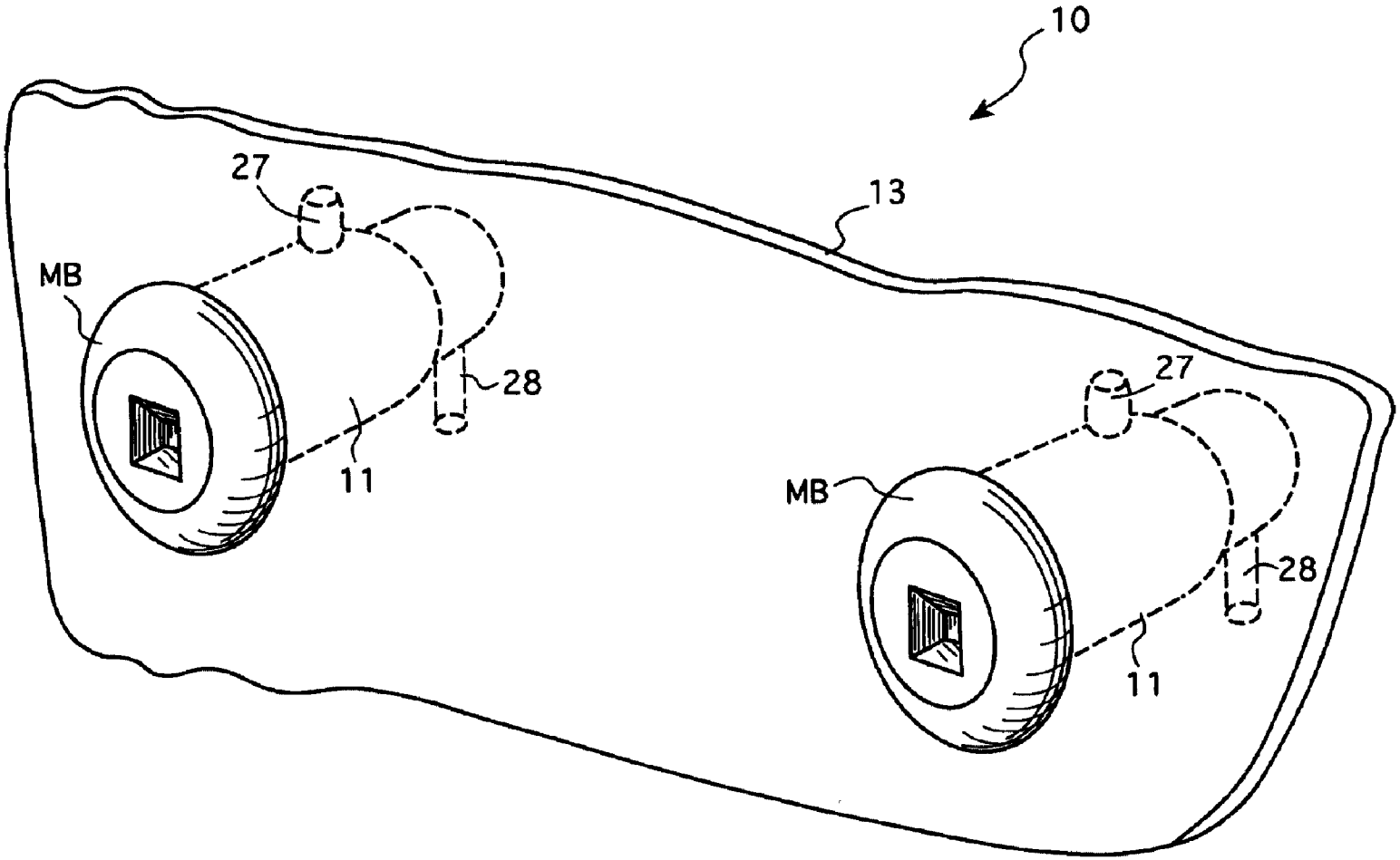
FIG. 1 is a diagrammatic illustration of a spa or hot tub in which one or more fluidic oscillator-type nozzle device has been used as the input to the spa.
Figure 3:
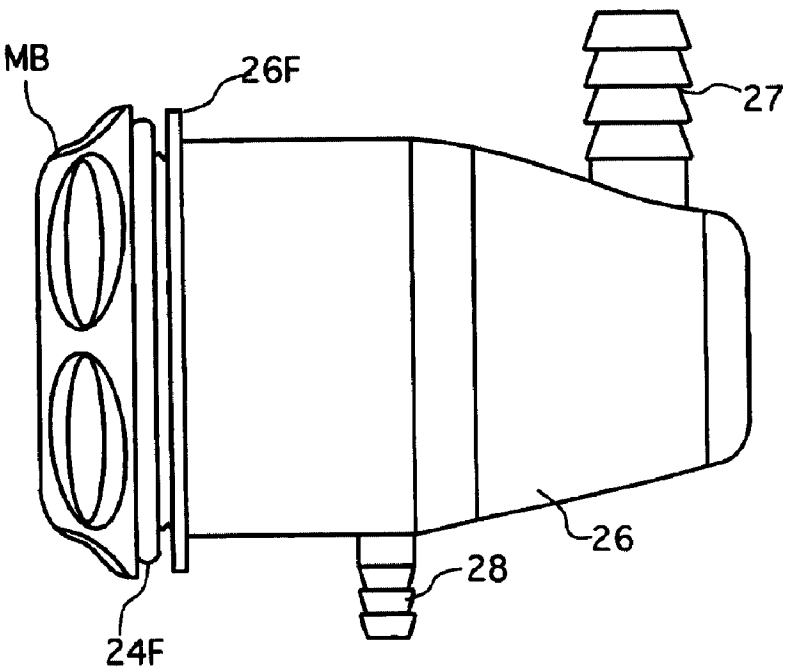
FIG. 3 is a side elevational view of a preferred form of the fluidic nozzle incorporating the invention.
Figure 2:
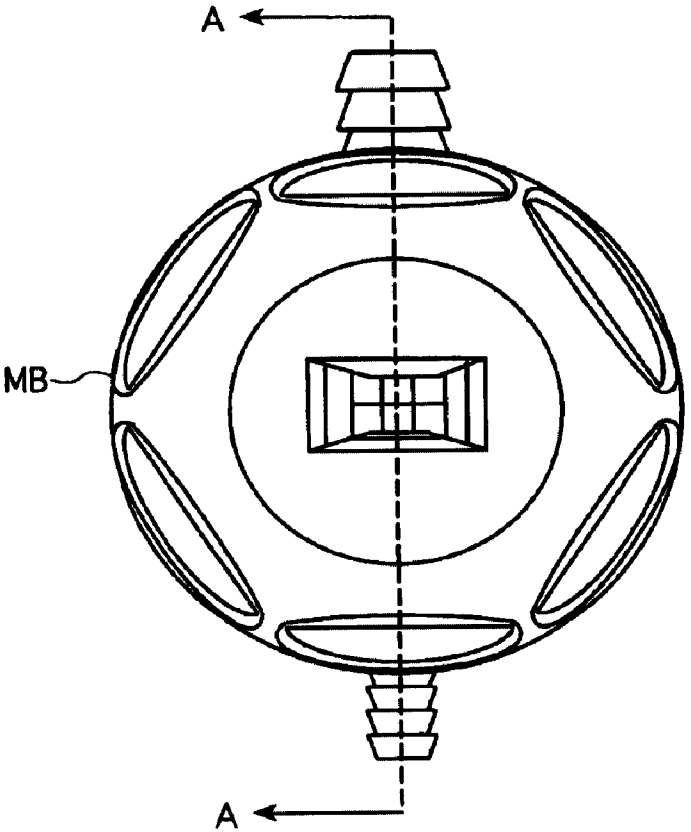
FIG. 2 is a front elevational view of a preferred form of the fluidic nozzle incorporating the invention.

Referring now to FIG. 1, a hot tub or spa 10 is shown as being supplied with water mixed with air by one or more fluidic nozzle devices 11 mounted in the walls 13 of the hot tub or spa 10. It will be appreciated that in a normal conventional hot tub or spa a plurality of nozzles are judiciously scattered around the tub to provide alternating pressure points to various individuals in the hot tub. The water is circulated from one or more drains, filtered and otherwise treated prior to recirculation.

Referring now to FIGS. 2–9, the preferred embodiment of the invention has one or more reversing chamber fluidic oscillators mounted in the walls SW of the hot tub at selected locations as diagrammatically illustrated in FIG. 1. Each fluidic oscillator 20 is made from molded plastic or fiberglass and is provided with a mounting bezel MB which clips onto a front ring 22 which has forward reprojecting male prongs 23 which are received in female apertures (not shown) in the mounting bezel MB. Front mounting ring 22 is annular and has a threaded exterior 24 for threadably engaging the interior threads 25 of rear housing 26. Rear housing 26 has a feed inlet or barb 27 for coupling to a supply of water and an air feed inlet or barb 28. The air feed inlet 28 is coupled to ambient air. Front mounting ring 24 has a flange 24F which cooperates with a flange 26F on the rear housing portion 26 which together with a gasket 29 sealingly clamps the nozzle to the wall of the hot tub or spa tub whenever the rear housing and the front flange are threadably engaged and drawn together. A rear gasket 30 provides a water-tight seal so that water fed into the water input pipe 27 fills the chamber defined by feed ring 31. Feed ring 31 defines two chambers, namely, a water chamber WC and an air chamber AC which is supplied with ambient air for aspirating via the outlet of the fluidic oscillator, and the water inlet 27 fills the water chamber WC with water and through power nozzle inlets 40, 41 to the reversing chamber oscillator which will be described in detail.

Figure 5A:
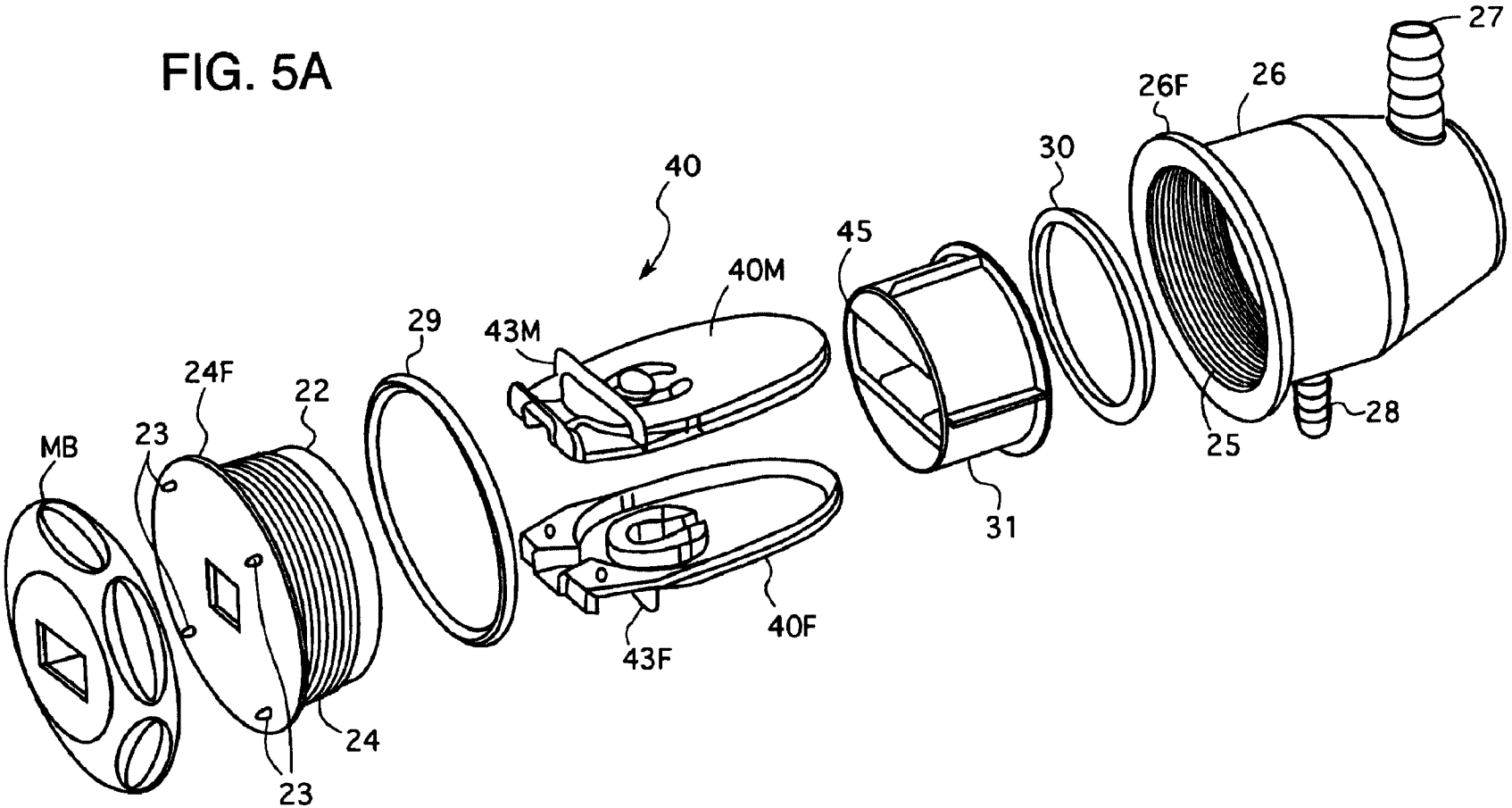
FIG. 5A is an exploded isometric showing the parts and their relative orientation.
Figure 7:
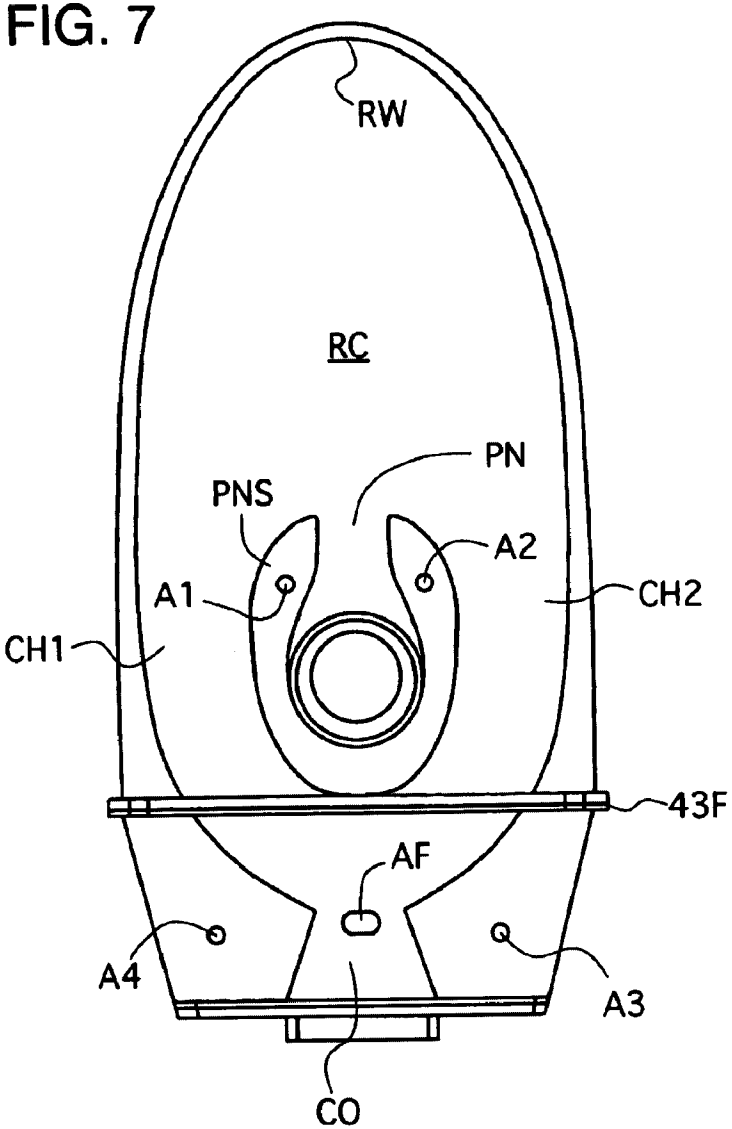
FIG. 7 is a top plan view illustrating the silhouette of the reversing chamber oscillator incorporating the invention.
Figure 8:
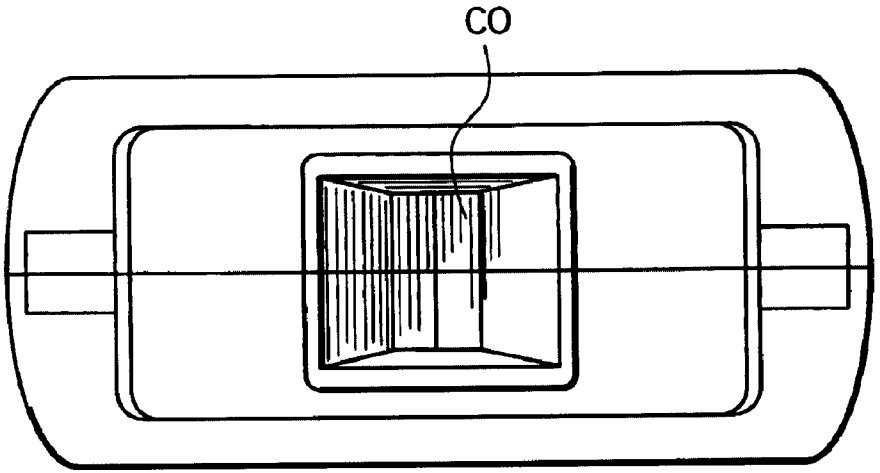
FIG. 8 is a front elevational view thereof.
Figure 9:
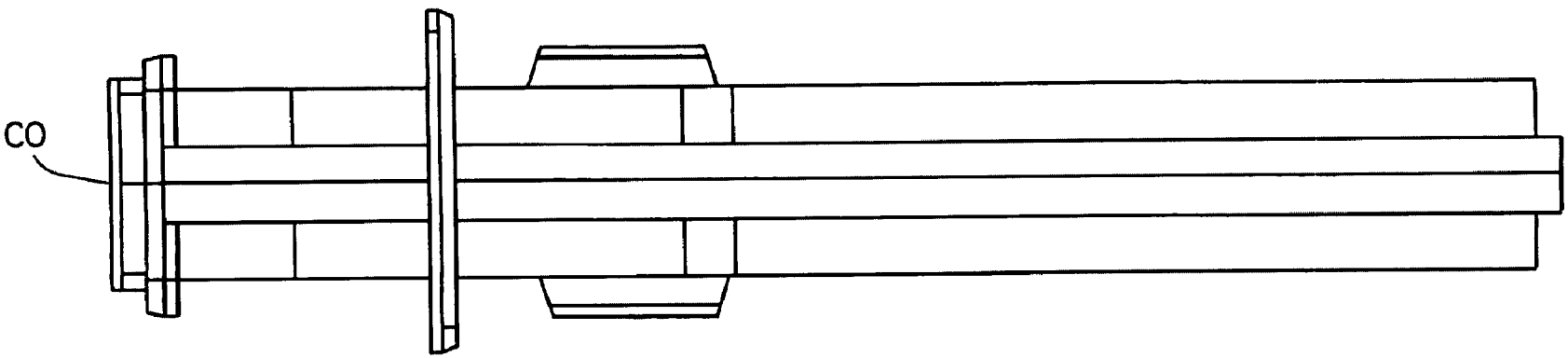
FIG. 9 is a side elevational view of the fluidic oscillator incorporating the invention.

Referring to FIG. 5A, the female portion 40F of the reversing chamber fluidic oscillator 40 and the male portion 40M are ultrasonically welded together using guide projections or prongs on the male member. Flanges 43F and 43M butt up against the rectangular aperture 45 in the feed ring 31 to thereby form the separator between the air chamber AC and the water chamber WC. The silhouette of the fluidic oscillator as best seen in FIG. 7 incorporates a power nozzle PN supplied with water under pressure from water chamber WC through ports 40 and 41 (see FIG. 5A). Reversing chamber RC has a reversing chamber wall RW. A pair of counter-rotating vortices are produced in the interaction chamber RC, and the jet of water is transferred around these vortices towards the exit passages CH1, CH2 at each side of the power nozzle, with the power nozzle structure PNS. The apertures AP1, AP2, AP3 and AP4 are for receiving projecting pins from the male portion for aligning and snapping the two oscillators halves in assembly prior to ultrasonic welding.

The instability of the jet of water cause the vortices formed in the reversing chamber RC to change in size, and the isometric vortices in turn cause the jet to deflect by a large amount thus setting up the oscillation process.

A pair of water passages CH1 and CH2 lead from the reversing or interaction chamber RC on each side of the power nozzle PN, respectively. These outlet passages or channels CH1 and CH2 are preferably smooth without any sharp directional changes and extend to intersect at a common outlet CO which has a pair of diverging sidewalls SW1 and SW2, respectively. Each outlet passage CH1 and CH2 have an upstream end beginning at the reversing chamber and a downstream end ending at the common outlet CO. Each of these outlet passages have the effect of lowering the frequency of oscillation to under 6 Hz, and in the preferred embodiment about 3 Hz or less.

Figure 4A:
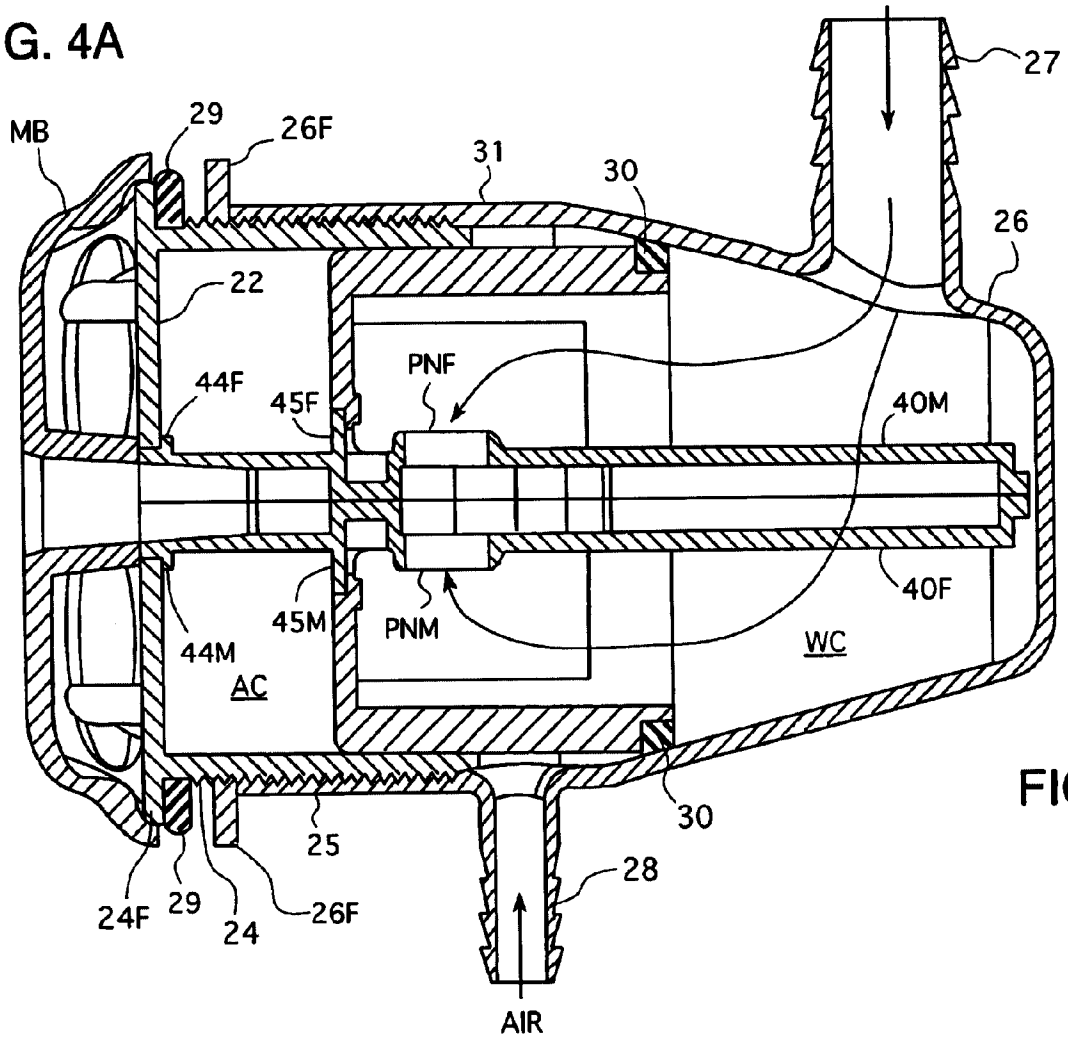
FIG. 4A is a sectional view taken on lines A—A of FIG. 2.
Figure 4B:
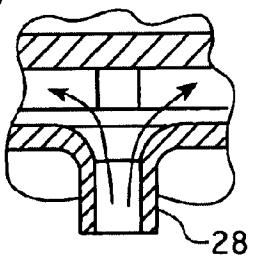
FIG. 4B is a partial sectional through the air inlet barb showing airflow to the air chamber.
Figure 5B:
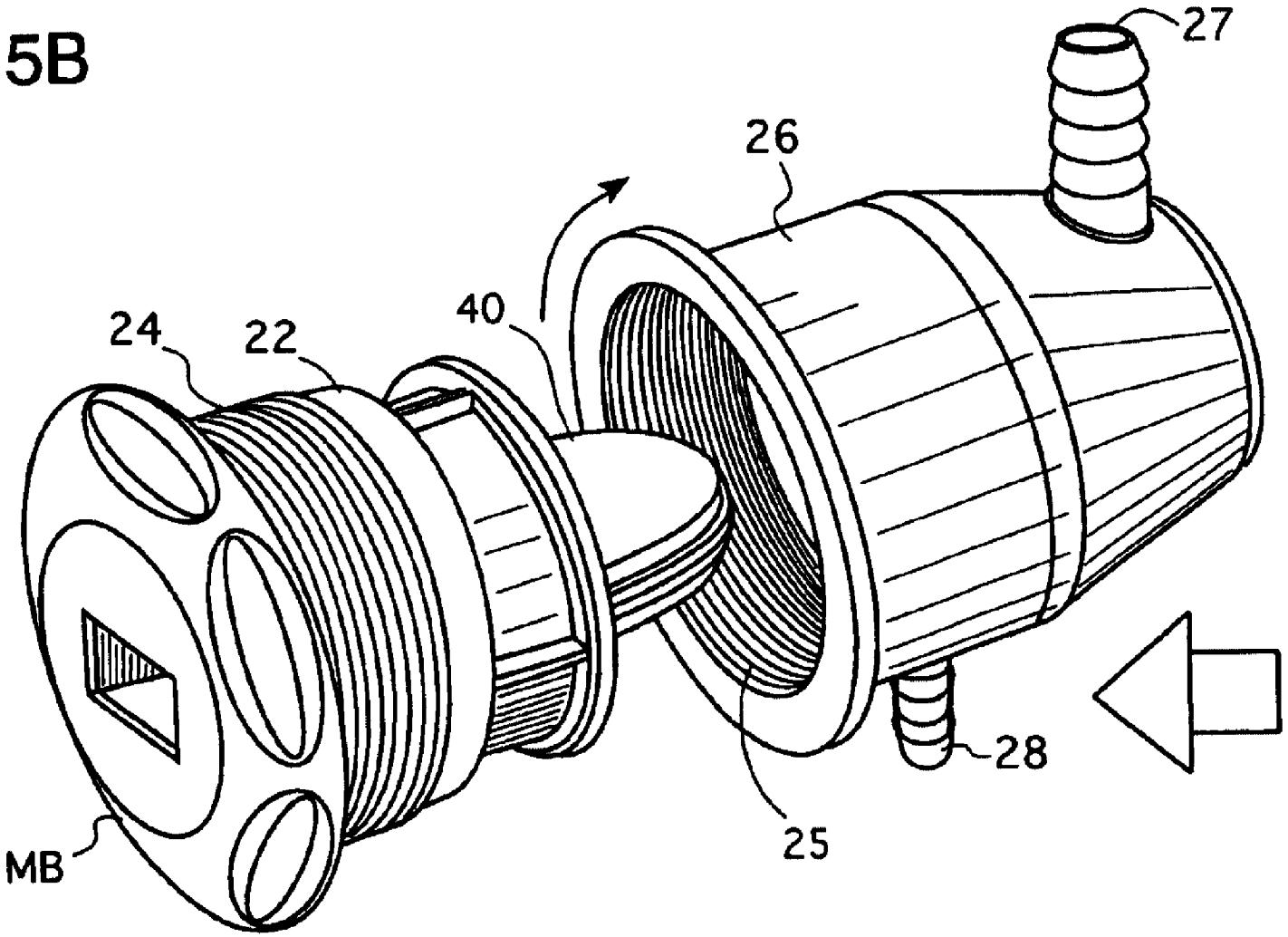
FIG. 5B shows the rear housing being screwed on to the front ring.
Figure 6:
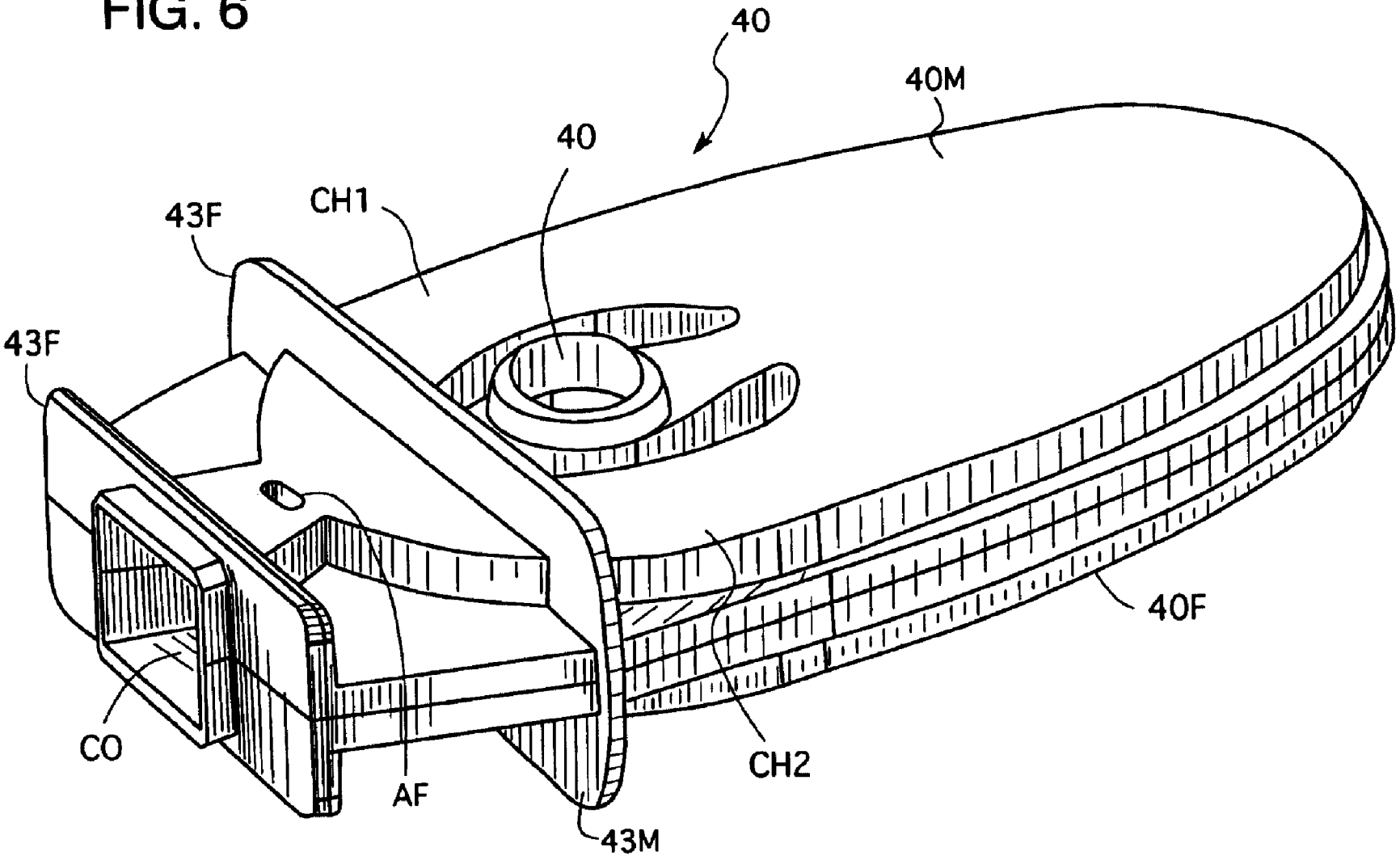
FIG. 6 is an isometric perspective view of the reversing chamber fluidic oscillator.

Air from air chamber AC is entrained through apertures AM and AF in the common outlet throat CO. FIGS. 4B and 5B show the airflow paths. It will be noted that the reversing chamber nozzle has a power nozzle inlet and a reversing surface RW opposite the power nozzle inlet with the outside wall surfaces and a pair of outlet passages CH1 and CH2 defining an oval shape. The source of air 22 which may or may not be under pressure is coupled through the air chamber AC to the pair of inlets AM and AF in the outlet throat CO to provide air bubbles which are entrained in the sweeping water output.

This type of reversing chamber oscillator has the lowest frequency for the same flow rate and appears to feel better to a spa tub occupant and provides a therapeutic massaging effect. As compared to three types of fluidic oscillators listed below, at the same fluid pressure (5 psi), the fluidic oscillator shown herein has the lowest operating frequencies:

| Oscillator Type | Frequency at 5 psi |
|---|---|
| Reversing Chamber | 3 Hz |
| Feedback | 6 Hz |
| Multiple Power Nozzle | 15–20 Hz |

Thus, all three nozzles have flow rates of roughly 8 gpm (gallons per minute) at 15 pounds per square inch (psi) operating pressure. The reversing chamber oscillator shown in detail herein also has much better packageability for the spa application, in that the length of the reversing chamber can be manipulated easier than the length of feedback channels or the feed configuration in the multiple power nozzle oscillators.

While other types of fluidic oscillators may be incorporated in the invention, the reversing chamber-type disclosed in FIGS. 2–9 is preferred because of its lower frequency and because of its much better packageability for spa applications in that the length of the reversing chamber can be manipulated easier than the length of feedback channels or the feed configuration in the multiple power nozzle oscillators. In addition, the low-frequency sweeping oscillation feature provides the therapeutic effect to the large muscle groups in the back and provides a more soothing massaging effect.

While preferred embodiments of the invention have been shown and illustrated and described, it will be appreciated that various other embodiments, adaptations and modifications to the invention will be readily apparent to those skilled in the art.

What is claimed is:

1. A therapeutic spa tub having a waterline and one or more therapeutic water nozzles for issuing jets of water into said tub, said one or more therapeutic water nozzles each comprising a housing having an inlet for receiving a flow of water under pressure, a fluidic oscillator having an oscillation chamber and a power nozzle coupled to said inlet and said oscillation chamber for projecting a first jet of water into said oscillation chamber, a common outlet, a pair of liquid outlet passages from said oscillation chamber for issuing a pair of periodically pulsating pulses of water into said spa tub below said waterline, and an air passage in said common outlet for selectively entraining ambient air in water passing through said common outlet.

2. A therapeutic spa tub having a waterline and one or more therapeutic water nozzles for issuing jets of water into said tub, said water nozzles each comprising a housing having an inlet for receiving a flow of water under pressure, a fluidic oscillator having an oscillation chamber and a power nozzle coupled to said inlet and said oscillation chamber for projecting a first jet of water into said oscillation chamber and a pair of outlets from said oscillation chamber for issuing a pulsating jet of water into said spa tub below said waterline, said fluidic oscillator is a reversing chamber oscillator and wherein said oscillation chamber has a reversing wall, said power nozzle being centrally located for issuing said first jet of said water toward said reversing wall, a common outlet, and said pair of outlets being constituted by a pair of liquid passages leading from said reversing chamber on each side of said power nozzle, respectively, for alternately carrying periodic pulses of said water and wherein said liquid passages are smoothly extended to intersect at said common outlet to ambient and water from said passages merge to form a low-frequency swept water jet below said waterline.

3. A therapeutic spa tub having a waterline and one or more therapeutic water nozzles for issuing jets of water into said tub, said water nozzles each comprising a housing having an inlet for receiving a flow of water under pressure, a fluidic oscillator having an oscillation chamber and a power nozzle coupled to said inlet and said oscillation chamber for projecting a first jet of water into said oscillation chamber and a pair of outlets from said oscillation chamber for issuing a pulsating jet of water into said spa tub below said waterline, said fluidic oscillator is a reversing chamber oscillator and wherein said oscillation chamber has a reversing wall, said power nozzle being centrally located for issuing said first jet of said water toward said reversing wall, a common outlet, and said pair of outlets being constituted by a pair of liquid passages leading from said reversing chamber on each side of said power nozzle, respectively, for alternately carrying periodic pulses of said water and wherein said liquid passages are smoothly extended to intersect at said common outlet to ambient and water from said passages merge to form a low-frequency swept water jet below said waterline, and wherein said nozzle has a threaded rear housing, a feed ring having a wall defining a water chamber surrounding said reversing chamber and an air chamber for coupling air to said common outlet for entrainment in said swept water jet.

* * * * *